US008162682B1

(12) United States Patent
Wu et al.

(10) Patent No.: US 8,162,682 B1
(45) Date of Patent: Apr. 24, 2012

(54) POWER ADAPTER COMBINATION

(75) Inventors: Jui-Hsiung Wu, Taipei (TW); Tong-Lin Zhang, Dongguan (CN)

(73) Assignees: Well Shin Technology Co., Ltd., Taipei (TW); Dongguan Well Shin Electronic Products Co., Ltd., Guangdong (CN)

( * ) Notice: Subject to any disclaimer, the term of this patent is extended or adjusted under 35 U.S.C. 154(b) by 0 days.

(21) Appl. No.: 13/008,023

(22) Filed: Jan. 18, 2011

(51) Int. Cl.
*H01R 13/44* (2006.01)

(52) U.S. Cl. ..... 439/131

(58) Field of Classification Search ..... 439/761, 439/131, 74, 171–174, 76, 856, 876, 140, 439/137, 353, 176
See application file for complete search history.

(56) References Cited

U.S. PATENT DOCUMENTS 4,997,381 A * 3/1991 Oh ..... 439/172
5,494,449 A * 2/1996 Chioo ..... 439/76.1
6,312,271 B1 * 11/2001 Tseng ..... 439/131
7,125,266 B1 * 10/2006 Huang ..... 439/131
7,344,385 B2 * 3/2008 Chen ..... 439/74
7,787,238 B2 * 8/2010 Liao et al. ..... 361/679.01
* cited by examiner

*Primary Examiner* — Edwin A. Leon
(74) *Attorney, Agent, or Firm* — Lin & Associates IP, Inc.

(57) ABSTRACT

The invention provides a power adapter combination including an adapter body and an adapter plug. The adapter body comprises a first casing having an inner space and a receiving recess structure with one side opened through the inner space, a circuit board disposed in the inner space, and a pair of connection terminals electrically connected with the circuit board and partially extending into the receiving recess structure. The adapter plug is detachably engaged into the receiving recess structure and comprises a second casing having a pair of slots thereon and a rear wall having a pair of holes, a bottom plate adapted to be assembled with the second casing, a pair of contact pins of which each has one pivoted end, is placed in one of the slots and is enabled to extend out of said one slot by rotation, and a pair of electrode structures mounted on the bottom plate and electrically connected with the contact pins, respectively. Each electrode structure has a half-pipe portion, wherein the pair of connection terminals are allowed to pass through the pair of holes of the rear wall of the second casing to electrically plug into the pair of half-pipe portions, respectively.

3 Claims, 4 Drawing Sheets

POWER ADAPTER COMBINATION

BACKGROUND OF THE INVENTION

1. Field of the Invention

The invention relates to a power adapter combination of which the adapter body and the adapter plug are in good electrical connection after combination.

2. Description of the Prior Art

The traditional power adapter assembly includes an adapter body and an adapter plug. The adapter body includes a casing, a circuit board, and a socket. The circuit board and the socket are disposed in the casing. The casing includes an upper casing and a lower casing. The lower casing has a rectangular recess structure having a slot at one side, wherein the slot has a recess portion inside. The adapter plug includes contact pins, a bolt and a plug. The bolt has a protrusion portion adapted to the recess portion of the slot. When the bolt is inserted into the slot, the protrusion portion of the bolt will engage with the recess portion of the slot with a sound indicating the adapter plug has been installed well. In addition, after the combination is finished, the plug is connected with the adapter body, and the contact pins are connected with the plug through metallic connection components, so as to make the power adapter work normally. However, since the adapter plug projects outward relative to the surface of the adapter body after combination, such structure is difficult to fabricate in the plastic molding process and costs much.

SUMMARY OF THE INVENTION

The main object of the invention is to provide a power adapter combination which has easy and low-cost manufacture.

According to an embodiment of the invention, the power adapter combination includes an adapter body and an adapter plug. The adapter body comprises a first casing having an inner space and a receiving recess structure with one side opened through the inner space, a circuit board disposed in the inner space, and a pair of connection terminals electrically connected with the circuit board and partially extending into the receiving recess structure. The adapter plug is detachably engaged into the receiving recess structure and comprises a second casing having a pair of slots thereon and a rear wall having a pair of holes, a bottom plate adapted to be assembled with the second casing, a pair of contact pins of which each has one pivoted end, is placed in one of the slots and is enabled to extend out of said one slot by rotation, and a pair of electrode structures mounted on the bottom plate and electrically connected with the contact pins, respectively. Each electrode structure has a half-pipe portion, wherein the pair of connection terminals are allowed to pass through the pair of holes of the rear wall of the second casing to electrically plug into the pair of half-pipe portions, respectively.

As described above, in the assembly of the power adapter combination of the present invention, the plugging of the connection terminals into the electrode structures not only fixes the adapter body and the adapter plug together, but also guarantees the electrical connection between the contact pins and the circuit board. Moreover, this combination has easy and low-cost manufacture.

The advantage and spirit of the invention may be understood by the following recitations together with the appended drawings.

BRIEF DESCRIPTION OF THE APPENDED DRAWINGS

DETAILED DESCRIPTION OF THE INVENTION

Figure 1:
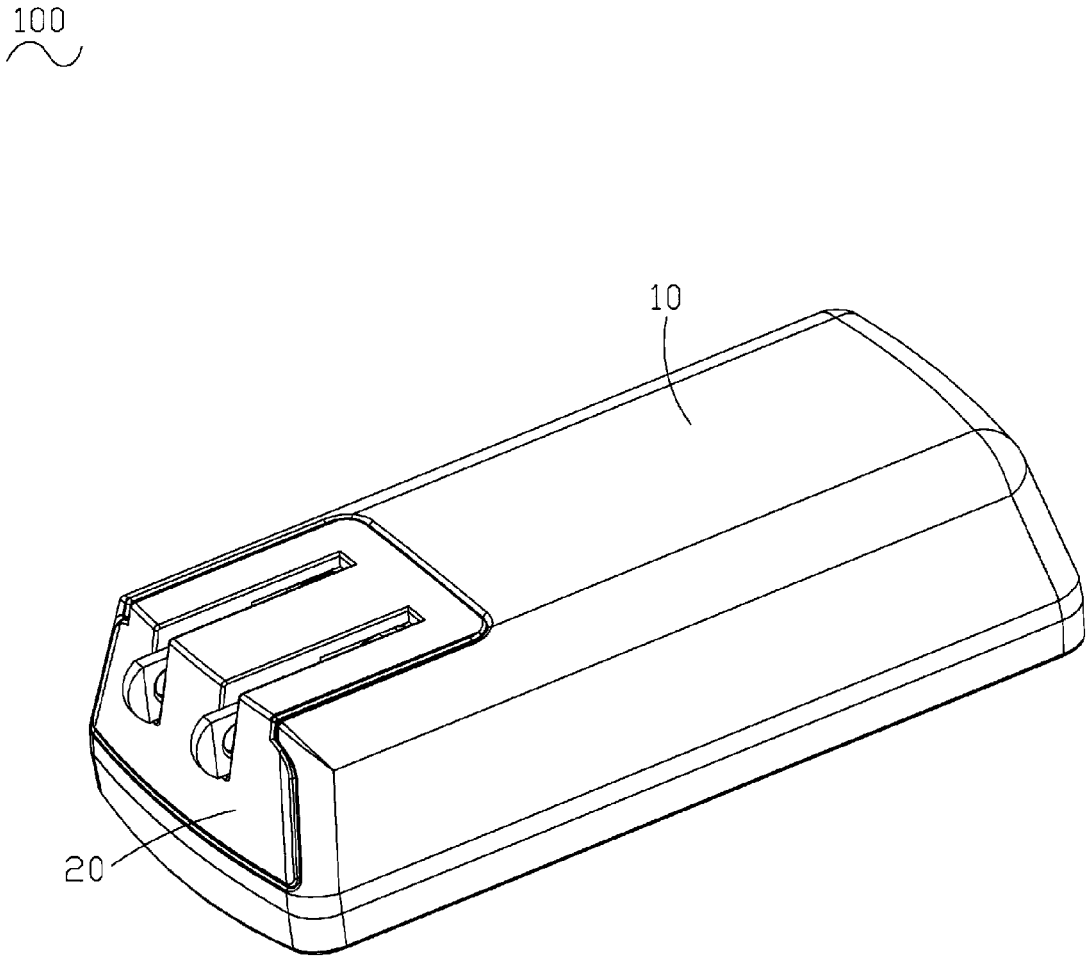
FIG. 1 is a perspective assembly view of the power adapter combination of the present invention.
Figure 2:
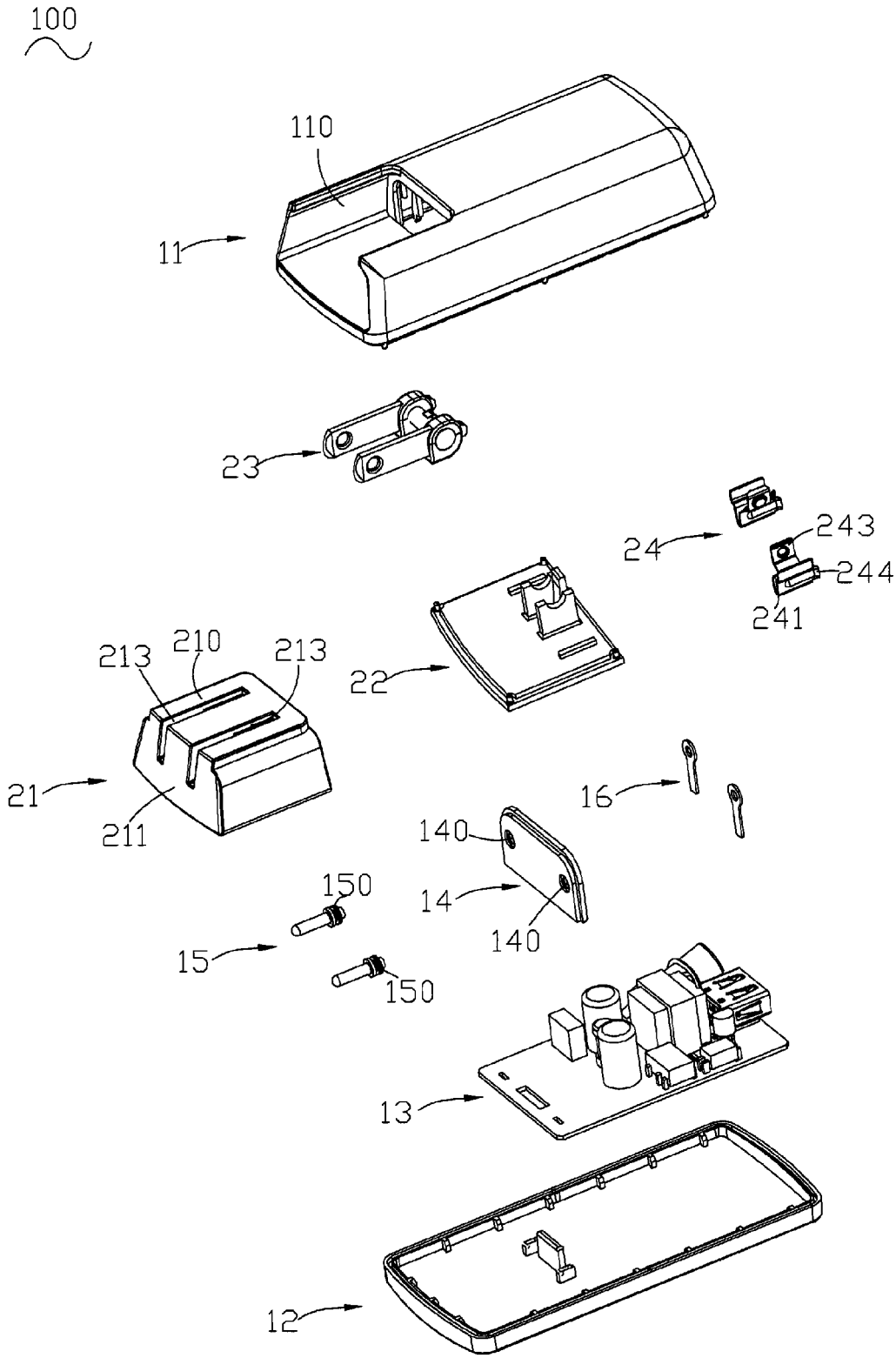
FIG. 2 is a perspective exploded view of the power adapter combination in FIG. 1.

Please refer to FIG. 1 and FIG. 2. The power adapter combination 100 includes an adapter body 10 and an adapter plug 20. The adapter body 10 comprises a casing (not marked), a circuit board 13 on which plural electronic components are mounted, and a pair of connection terminals 15 electrically connected with the circuit board 13. The casing comprises an upper casing 11 and a lower casing 12. The upper casing 11 has an inner space and a receiving recess structure 110 formed at the front end thereof with one side opened through the inner space of the upper casing 11. Each of the connection terminals 15 extends into the receiving recess structure 110 by one end thereof. The circuit board 13 is mounted onto the lower casing 12 and disposed in the inner space of the upper casing 11. A fixing plate 14 is vertically mounted onto the front part of the circuit board 13 and has two holes 140 thereon.

Besides, two upright welding pieces 16 are disposed on the circuit board 13. Each connection terminal 15 is column-shaped and has a flange 150 near a rear end thereof. The rear ends of the pair of connection terminals 15 pass through the two holes 140 to the rear side of the fixing plate 14 respectively till the two flanges 150 abut against the fixing plate 14. Each welding piece 16 is welded with the rear end of one corresponding connection terminal 15 at one end thereof and welded with the circuit board 13 at the other end thereof in this way, the connection terminals 15 are electrically connected with the circuit board 13.

Figure 4:
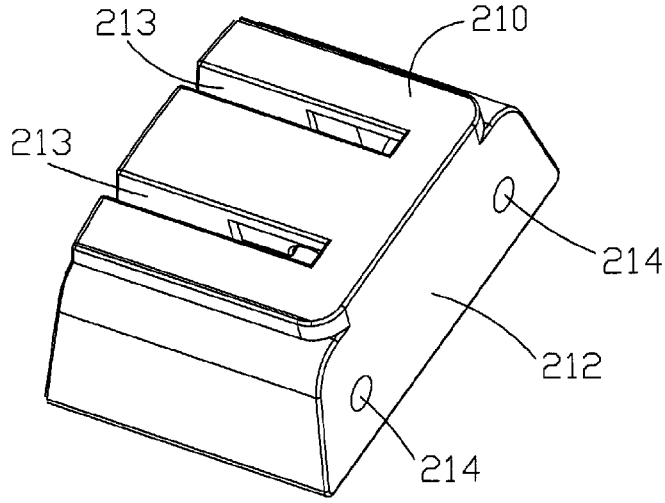
FIG. 4 is a perspective view of the casing of the adapter plug in FIG. 2.
Figure 5:
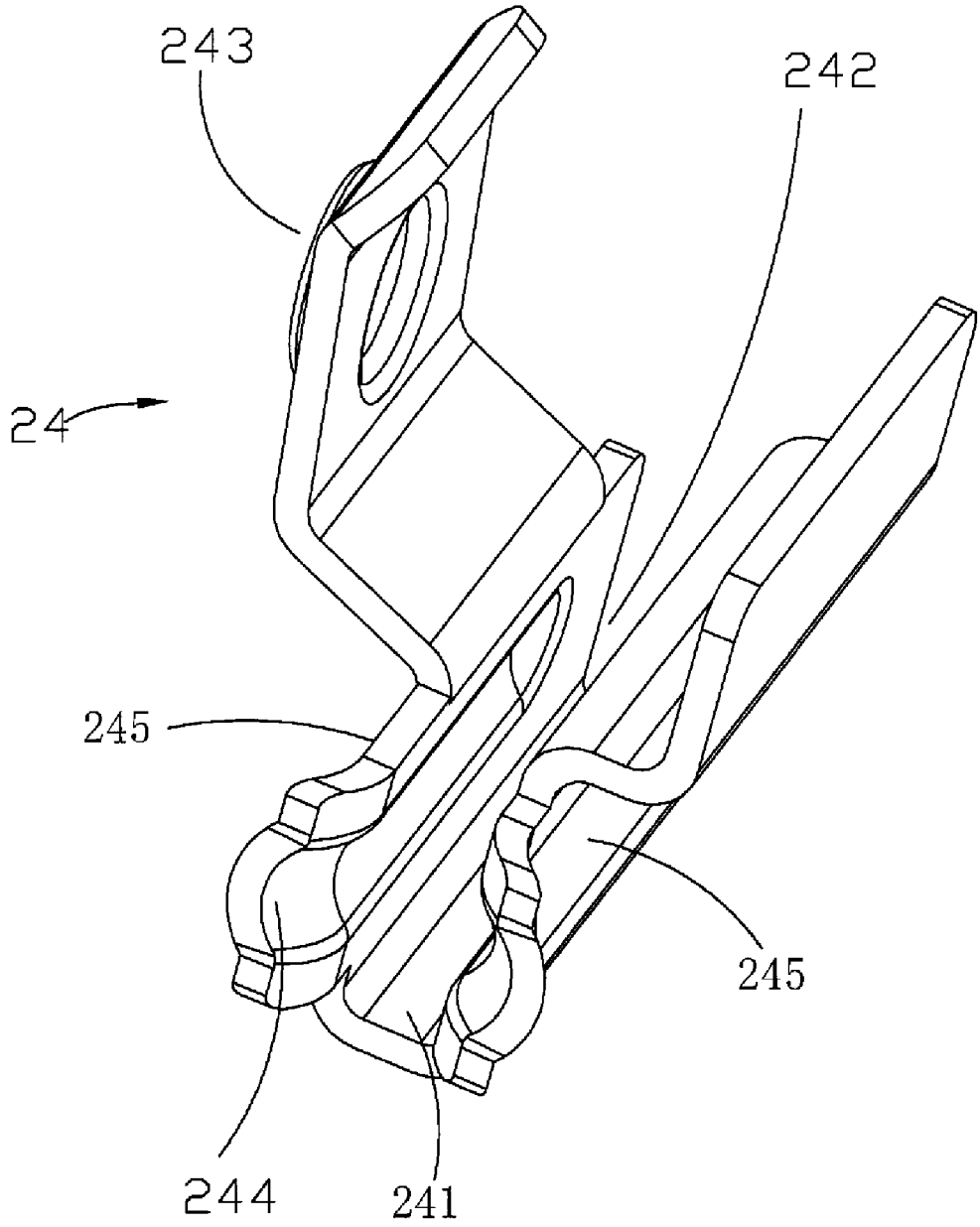
FIG. 5 is a perspective view in large scale of the electrode structure in FIG. 2.

Please refer to FIG. 2, FIG. 4 and FIG. 5. The adapter plug 20 comprises a casing 21, a bottom plate 22 adapted to be assembled with the casing 21, a pair of contact pins 23 of which each is disposed on the bottom plate 22 and has one pivoted end, and a pair of electrode structures 24 mounted on the bottom plate 22 and electrically connected with the contact pins 23.

The casing 21 is detachably engaged into the receiving recess structure 110 and comprises a top wall 210, a front wall 211 and a rear wall 212, wherein a pair of slots 213 are formed on the top wall 210 and extend to the front wall 211. Each contact pin 23 is placed in one of the slots 213 and is enabled to extend out of said one slot 213 by rotation of its pivoted end. A pair of holes 214 are opened on the rear wall 212. Each electrode structure 24 comprises an elongated base 241, two extension portions 245 projecting upward from two sides of the elongated base 241 so as to form a half-pipe portion 242, an resilient arm 243 projecting outward and upward from top of one extension portion 245. The rear end of each half-pipe portion protrudes outward to form a resilient clamper 244. The half-pipe portions 242 are for the connection terminals 15 to plug into. One side of each resilient arm 243 abuts against one corresponding contact pin 23, so as to make the pair of contact pins 23 electrically connect with the pair of electrode structures 24.

Figure 3:
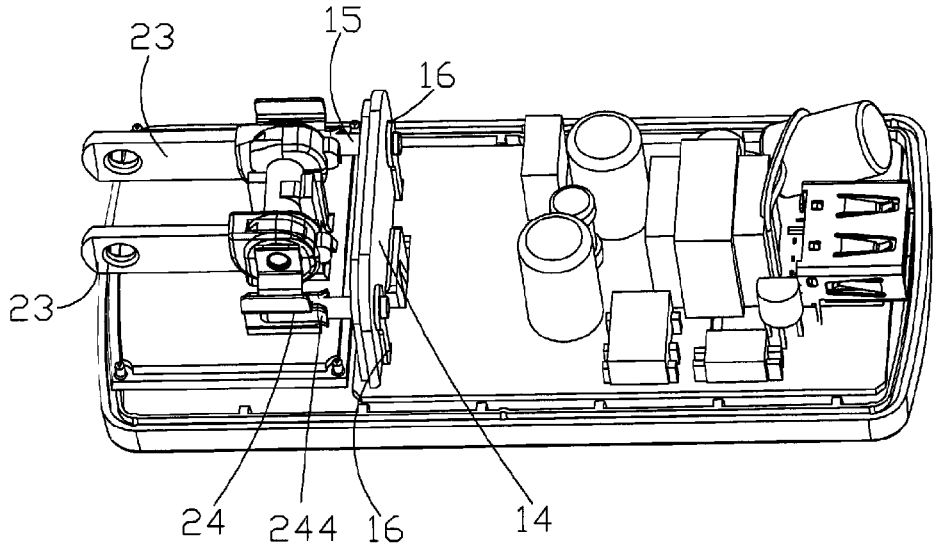
FIG. 3 is a perspective view of the power adapter combination in FIG. 2 after an upper casing is removed.

Please refer to FIGS. 2 through 4. In the assembly of the power adapter combination 100 of the present invention, the connection terminals 15 are firstly arranged and electrically connected with the circuit board 13 via the two upright welding pieces 16 and the fixing plate 14 as mentioned above. Next, the circuit board 13 is mounted on the lower casing 12, and then the upper casing 11 is assembled with the lower casing 12. Next, the contact pins 23 and the electrode structures 24 are arranged on the bottom plate 22. Next, the bottom plate 22 is assembled to the casing 21 with the contact pins 23 and the electrode structures 24 electrically connected with each other. Finally, the adapter plug 20 is inserted into the recess structure 110 of the upper casing 11, so that the connection terminals 15 pass through the holes 214 to be electrically plugged into the half-pipe portions 242 of the electrode structures 24, respectively. Thus, the contact pins 23 can be electrically connected with the circuit board 13 through the electrode structures 24 and the connection terminals 15. Besides, the contact pins 23 keep being electrically connected with the circuit board 13 during rotation. After rotated to extend out of the slots 213, the contact pins 23 can be connected with external power sources. After the connection terminals 15 are plugged into the half-pipe portions 242 of the electrode structures 24, the resilient clampers 244 will clamp the connection terminals 15 tightly to ensure the electrical connection.

As described above regarding the power adapter combination 100 of the present invention, the plugging of the connection terminals 15 into the electrode structures 24 not only fixes the adapter body 20 and the adapter plug 10 together, but also guarantees the electrical connection between the contact pins 23 and the circuit board 13. Moreover, this combination has easy and low-cost manufacture.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A power adapter combination, comprising:

an adapter body comprising a first casing having an inner space and a receiving recess structure with one side opened through the inner space, a circuit board disposed in the inner space, and a pair of connection terminals electrically connected with the circuit board and partially extending into the receiving recess structure; and an adapter plug detachably engaged into the receiving recess structure and comprising a second casing having a pair of slots thereon and a rear wall having a pair of holes, a bottom plate adapted to be assembled with the second casing, a pair of contact pins of which each has one pivoted end, is placed in one of the slots and is enabled to extend out of said one slot by rotation, and a pair of electrode structures mounted on the bottom plate and electrically connected with the contact pins, respectively, each electrode structure having a half-pipe portion, wherein the pair of connection terminals are allowed to pass through the pair of holes to electrically plug into the pair of half-pipe portions, respectively;

wherein the adapter body further comprises two upright welding pieces and a fixing plate vertically mounted onto the circuit board and having two holes, each connection terminal is column-shaped and has a flange near a rear end thereof, the rear ends of the pair of connection terminals pass through the two holes of the fixing plate respectively till the two flanges abut against the fixing plate, and each welding piece is welded with the rear end of one corresponding connection terminal at one end thereof and welded with the circuit board at the other end thereof.

2. The power adapter combination of claim 1, wherein each electrode structure comprises an elongated base, two extension portions projecting upward from two sides of the elongated base so as to form the half-pipe portion, a resilient arm projecting outward and upward from top of one extension portion to connect with one contact pin at one side thereof.

3. The power adapter combination of claim 2, wherein a rear end of each half-pipe portion protrudes outward to form a resilient clamper.

* * * * *